US006534736B1

(12) United States Patent
Lee et al.

(10) Patent No.: US 6,534,736 B1
(45) Date of Patent: Mar. 18, 2003

(54) KEY SWITCH OF KEYBOARD UNIT

(75) Inventors: Sung-jin Lee, Gyeonggi-do (KR); Soon-kyo Hong, Seoul (KR); Chul-woo Lee, Gyeonggi-do (KR); Young-woo Huh, Seoul (KR); Woo-jong Lee, Gyeonggi-do (KR); Woo-jong Cho, Gyeonggi-do (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 10/053,589

(22) Filed: Jan. 24, 2002

(30) Foreign Application Priority Data

Sep. 11, 2001 (KR) ..... 2001-55921

(51) Int. Cl.[7] ..... H01H 13/70
(52) U.S. Cl. ..... 200/344

(58) Field of Search ..... 200/344, 345, 200/517, 5 A, 341, 342, 343

*Primary Examiner*—Elvin Enad
*Assistant Examiner*—M. Fishman
(74) *Attorney, Agent, or Firm*—Staas & Halsey LLP

(57) ABSTRACT

A key switch of a keyboard of the present invention includes a key cap and an elastic body which supports and allows the key cap to elastically move up and down. The elastic body is a band shaped structure and includes end portions which are pivotally supported above a substrate, a central portion bulged to contact a bottom surface of the key cap, and curved portions having a curvature opposite to that of the central portion disposed between corresponding ones of the end portions and the central portion. The curved portions of the elastic body are deformed at a position lower than an upper surface of the substrate. Therefore, the overall height of the key switch can be reduced, allowing for the manufacture of a slimmer keyboard unit.

17 Claims, 8 Drawing Sheets

KEY SWITCH OF KEYBOARD UNIT

CROSS-REFERENCE TO RELATED APPLICATIONS

This application claims the benefit of Korean Application No. 2001-55921, filed Sep. 11, 2001, in the Korean Industrial Property Office, the disclosure of which is incorporated herein by reference.

BACKGROUND OF THE INVENTION

1. Field of the Invention

The present invention relates to a key switch of a keyboard unit used as an input device for an information processor, and more particularly, to a key switch of a keyboard unit which is slim.

2. Description of the Related Art

FIG. 1 shows an information processor such as a notebook computer or a personal digital assistant (PDA) with a conventional keyboard unit 100 having a plurality of key switches 110 as an information input unit.

Each of the key switches 110, as shown in FIGS. 2 and 3, includes a key cap 111 which receives a pressure from a user's finger, a cross link 113 which supports and allows the key cap 111 to move up and down above a substrate 115, a contact terminal portion 114 which generates an electrical signal in response to a pressure provided on the substrate 115, and a rubber dome 112 made of an elastic body which elastically supports the key cap 111 thereunder having a contact protrusion 112*a* at a center of an inner portion of the rubber dome 112. As the key cap 111 is pressed down and lowered, the contact protrusion 112*a* presses against the contact terminal portion 114.

FIG. 4 shows that as a user presses the key cap 111, the rubber dome 112 under the key cap 111 is pressed and elastically deforms as the contact protrusion 112*a* contacts the contact terminal portion 114. Upon contact, an electric signal assigned to the key switch 110 is generated. As the force pressing the key cap 111 is removed, the rubber dome 112 is elastically restored and pushes the key cap 111 upward to its original position.

FIG. 5 shows a relationship between the pressure acting on the rubber dome 112 as the key cap 111 is pressed and the amount of deformation of the rubber dome 112 corresponding to the pressure. That is, as the pressure acting on the rubber dome 112 increases, the amount of deformation of the rubber dome 112 also gradually increases. However, as the pressure reaches a predetermined pressure F1, deformation of the rubber dome 112 occurs radically, and the rubber dome 112 sinks even if the pressure is reduced. This is a buckling phenomenon which provides a user with a sense of manipulation and that a sufficient pressure is applied to the key switch 110. That is, as the key cap 111 of the key switch 110 is pressed, the key cap 111 presses the rubber dome 112 and the rubber dome 112 is gradually pressed and deformed. Upon the pressure F1, the buckling phenomenon occurs, and the rubber dome 112 suddenly sinks inward. This phenomenon allows the user to sense that a sufficient pressure has been applied to generate an input signal and provides a buckling phenomenon is necessary for the user to feel the sense of completeness during a manipulation of the corresponding key switch 110.

Recently, there has been an increasing demand for a slimmer information processor requiring a keyboard unit with a reduced height. However, in a conventional key switch structure, height reduction of the key switch has been limited by the installation of the rubber dome structure. For example, with reference to FIG. 3, a typical height of a stroke h1 from the initial position of the contact protrusion 112*a* to the contact position with the contact terminal portion 114 is 2.4 mm. That is, as the key cap 111 is pressed 2.4 mm, the contact protrusion 112*a* presses against the contact terminal portion 114 and causes the buckling phenomenon of the rubber dome 112 to provide a sense of manipulation. In order to reduce the height of the key switch 110, the height h2 of the rubber dome 112 can be reduced. However, if the height h2 is too short, the buckling phenomenon is not produced properly. In addition, a restoration force which pushes the key cap 111 to its original position is weakened improperly. Furthermore, if a rubber is used for the rubber dome 112, resistance to a fatigue destruction is lowered significantly as the height h2 is arbitrarily reduced. That is, to sufficiently perform a function of the key switch 110, the rubber dome 112 must endure a load of about 60 gf which is repeated 10,000,000 times or more. However, if the height h2 of the rubber dome 112 is reduced arbitrarily, fatigue destruction of the rubber dome 112 is likely to occur well before the repetition of 10,000,000 strokes.

SUMMARY OF THE INVENTION

Accordingly, it is an object of the present invention to provide an improved key switch structure with a decrease in overall height while maintaining a smooth and stable pressing operability.

Additional objects and advantages of the invention will be set forth in part in the description which follows and, in part, will be obvious from the description, or may be learned by practice of the invention.

To achieve the above and other objects of the present invention, there is provided a key switch of a keyboard comprising a substrate, a contact terminal portion provided on the substrate, a key cap which selectively moves up and down installed above the contact terminal portion, and an elastic body which supports and allows the key cap to elastically move up and down. The elastic body is a band shaped structure and comprises a protruding portion on one side of the elastic body which presses the contact terminal portion as the key cap moves down, end portions which pivot and are supported above the substrate, a central portion which is bulged to contact a bottom surface of the key cap, and curved portions having an opposite curvature to that of the central portion which includes first curved portion disposed between one of the end portions and the central portion, and second curved portion disposed between the other of the end portions and the central portion.

According to another embodiment of the present invention, a key switch of a keyboard comprises a substrate, a key cap which selectively moves up and down installed above the substrate, an elastic body which supports and allows the key cap to elastically move up and down, and a piezoelectric element coating film coated on a surface of the elastic body which generates an electric signal according to a deformation of the elastic body.

BRIEF DESCRIPTION OF THE DRAWINGS

The above and other objects and advantages of the present invention will become more apparent and more readily appreciated by describing in detail preferred embodiments thereof with reference to the accompanying drawings in which.

DETAILED DESCRIPTION OF THE EMBODIMENTS

Figure 1:
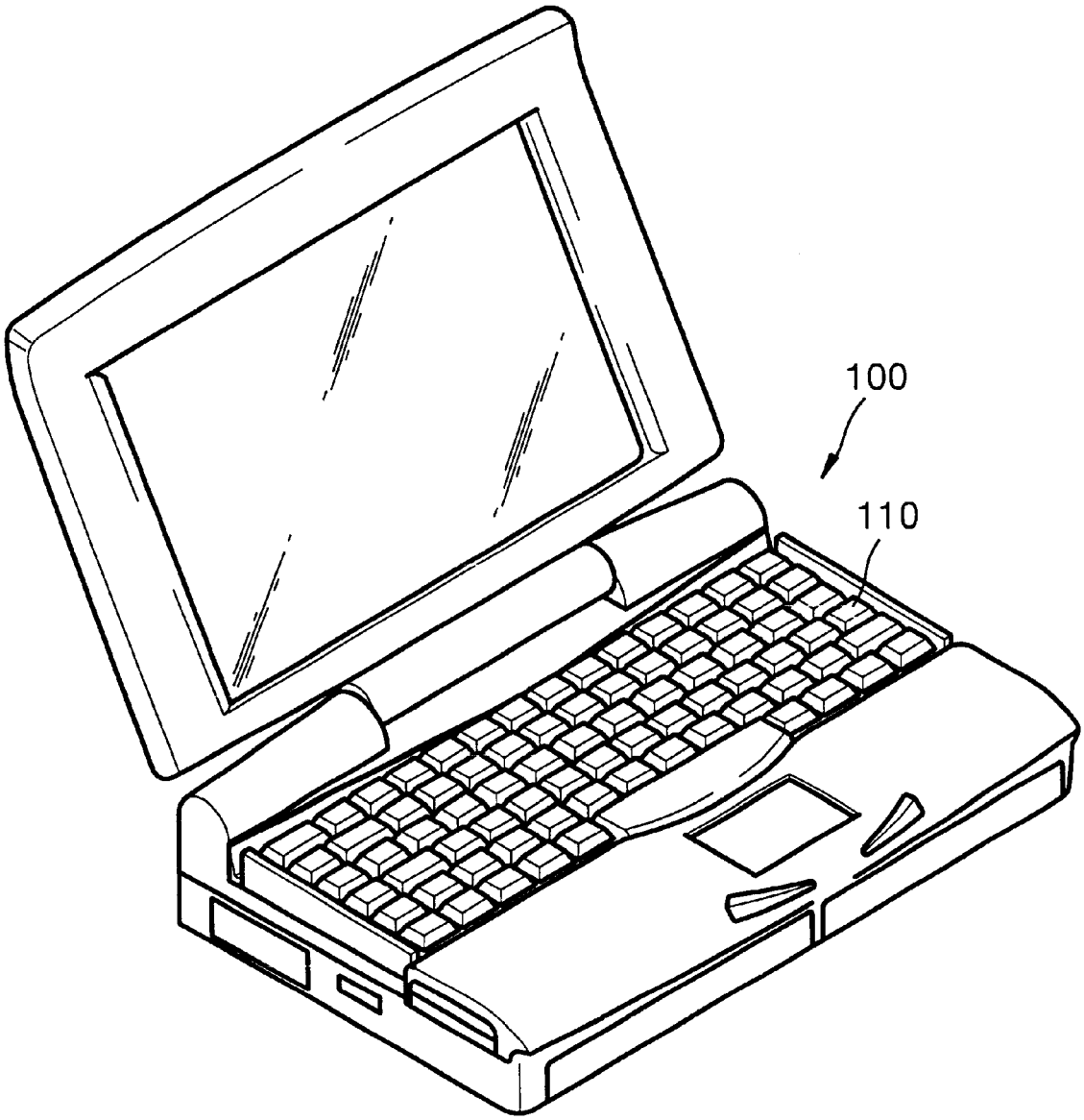
FIG. 1 (PRIOR ART)
FIG. 1 is a perspective view of a keyboard unit adopting a conventional key switch.

Reference will now be made in detail to the present preferred embodiments of the present invention, examples of which are illustrated in the accompanying drawings, wherein like reference numerals refer to the like elements throughout. The embodiments are described blow in order to explain the present invention by referring to the figures.

Figure 6:
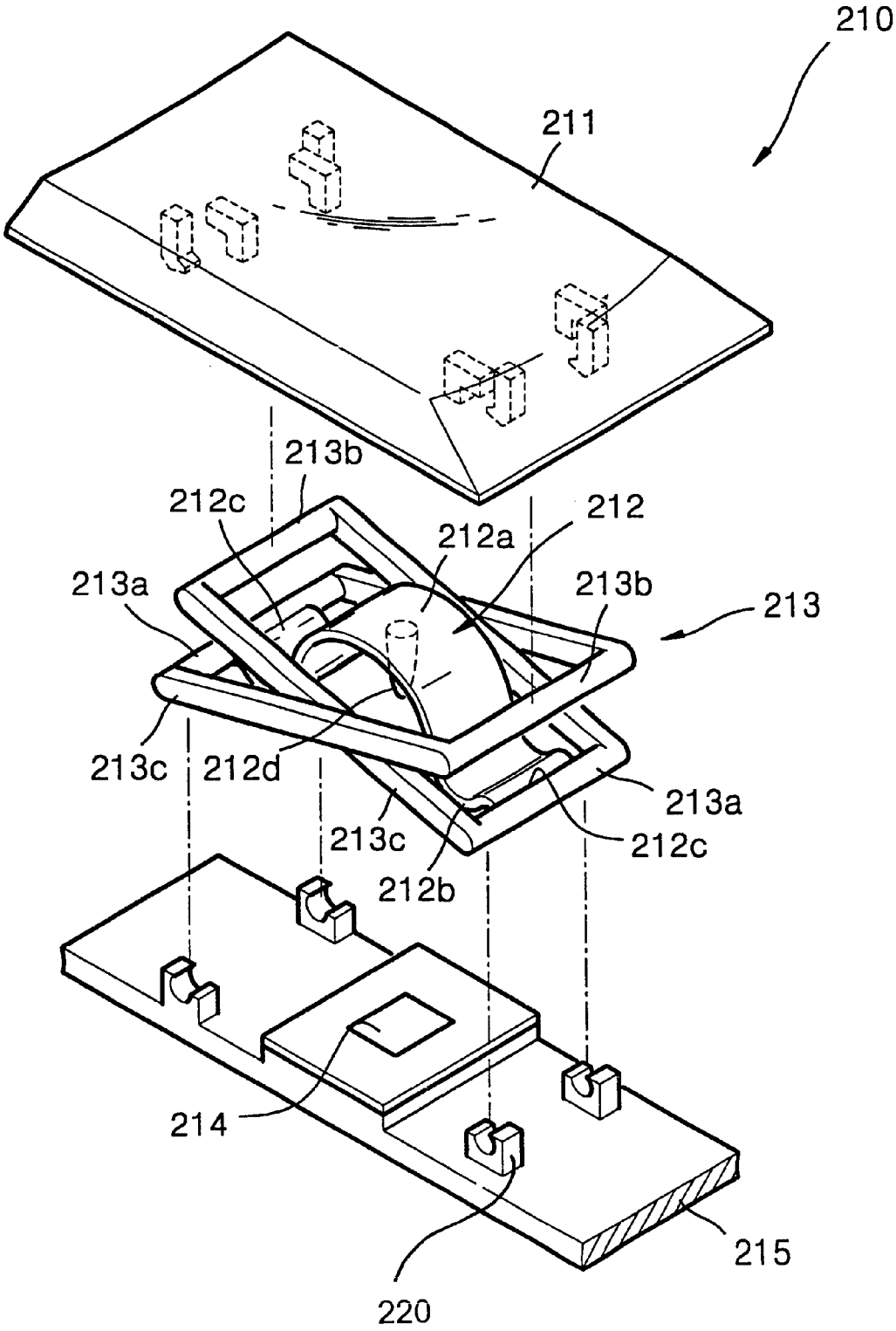
FIG. 6 is an exploded perspective view of a key switch according to an embodiment of the present invention.
Figure 7:
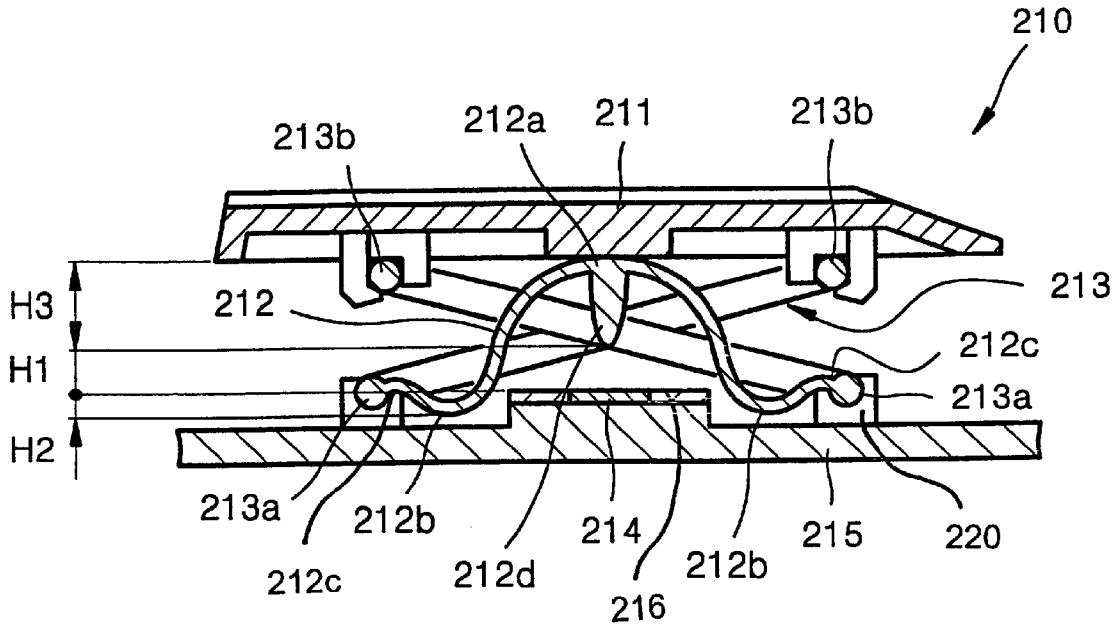
FIGS. 7 and 8 are sectional views showing the key switch of FIG. 6 before and after manipulation
Figure 8:
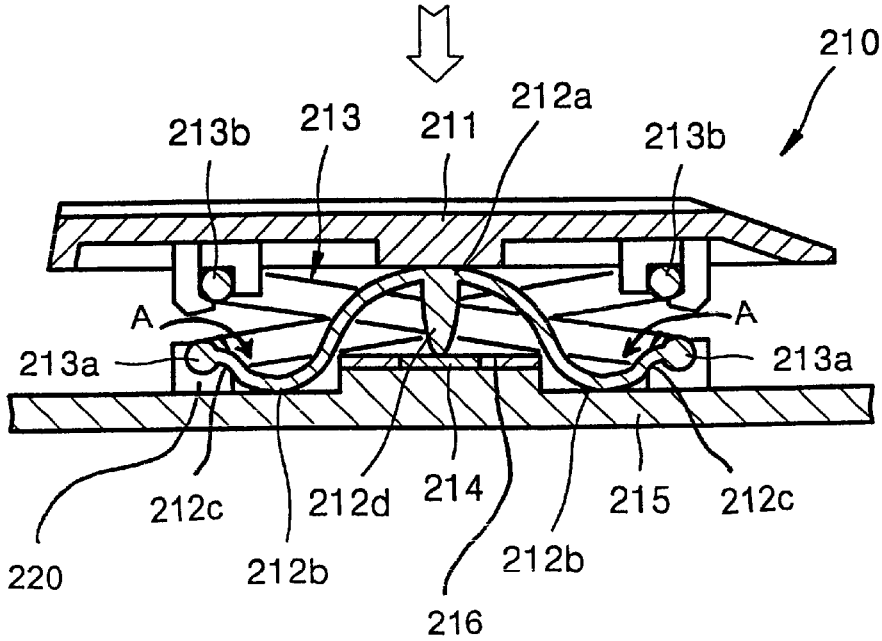

FIGS. 6 through 8 show the structure of a key switch 210 according to an embodiment of the present invention. The key switch 210 includes a key cap 211 which receives a down pressure from a user, a cross link 213 which supports and allows the key cap 211 to move up and down above a substrate 215, a contact terminal portion 214 provided on the substrate 215 which generates an electric signal in response to a pressing force, and an elastic body 212 which elastically supports the key cap 211 thereunder and includes a contact protrusion 212*d* at a center thereof which presses against the contact terminal portion 214 as the key cap 211 moves down.

The cross link 213 comprises short side portions 213*a* which pivot and are supported above the substrate 215, and short side portions 213*b* connected to the short side portions 213*a* by long side portions 213*c*, The short side portions 213*b* are coupled to a bottom surface of the key cap 211, whereas the short side portions 213*a* are connected to the substrate 215 at clips 220.

The elastic body 212 is a band shaped structure and further includes a plurality of curvatures. That is, each of end portions 212*c* of the elastic body 212 is coupled to a corresponding one of short side portions 213*a* of the cross link 213 supported at the substrate 215 so as to pivot together with the corresponding short side portion 213*a*. A central portion 212*a* is bulged to contact the bottom surface of the key cap 211. Curved portions 212*b* having a curvature opposite to that of the central portion 212*a* is formed between corresponding ones of the end portions 212*c* and the central portion 212*a*. The buckling phenomenon described above occurs at the curved portions 212*b* in this embodiment.

According to an aspect of the present invention, the elastic body 212 is formed of the same plastic material as that used for the cross link 213. However, it is understood that any pliable material could be used.

FIG. 8 shows that as a user presses the key cap 211, the central portion 212*a* of the elastic body 212 is pressed down and sinks. Accordingly, the end portions 212*c* of the elastic body 212 coupled to the short side portions 213*a* of the cross link 213 rotate in directions as indicated by arrows A. The curved portions 212*b* concavely deform in response to the pressure generated as the central portion 212*a* is pressed down and the movement generated as the end portions 212*c* rotate. As a result, the contact protrusion 212*d* presses against the contact terminal portion 214 to generate an electrical signal. A buckling phenomenon occurs at the curved portions 212*b* so as to allow the user pressing the key cap 211 to receive a sense of completion of manipulation of the key switch 210.

Figure 2:
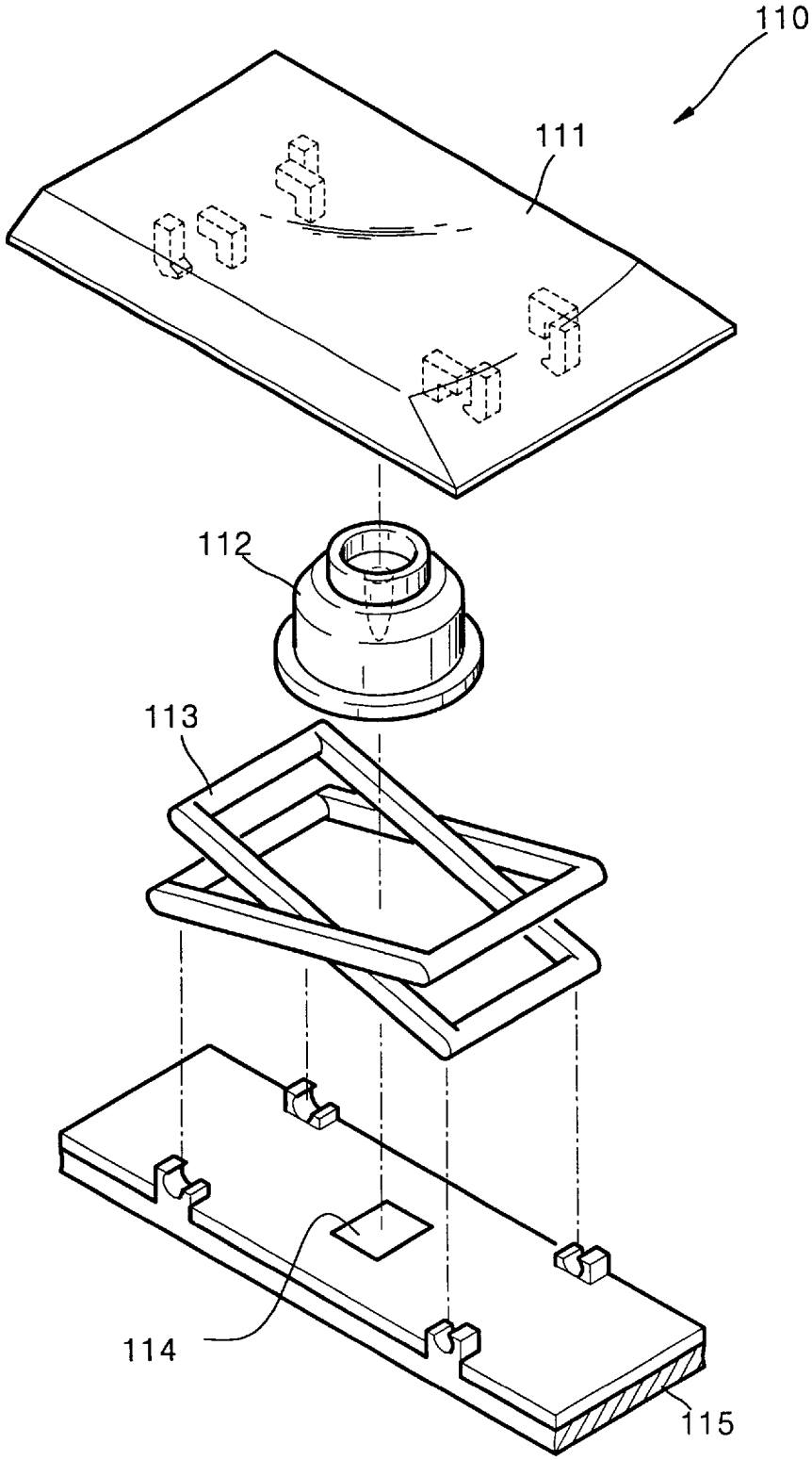
FIG. 2 (PRIOR ART)
FIG. 2 is an exploded perspective view of the key switch of FIG. 1.

The curved portions 212*b* of the elastic body 212 are deformed at a position lower than an upper surface 216 of the substrate 215 where the contact terminal portion 214 is installed. Therefore, the overall height of the key switch 210 can be reduced. That is, in the conventional key switch structure 110 shown in FIG. 2, the rubber dome 112 is an elastic body that is installed above the contact terminal portion 114 on the upper surface of the substrate 115. Therefore, both deformation and restoration actions are performed only above the contact terminal portion 114. In contrast, in the embodiment of the invention shown in FIGS. 6 to 8, since the curved portions 212*b* of the elastic body 212, which causes the buckling phenomenon, are deformed under the upper surface 216 of the substrate 215, the overall height of the key switch 210 can be reduced by reducing the height of a portion of the key switch 210 protruding above the substrate 215.

Figure 3:
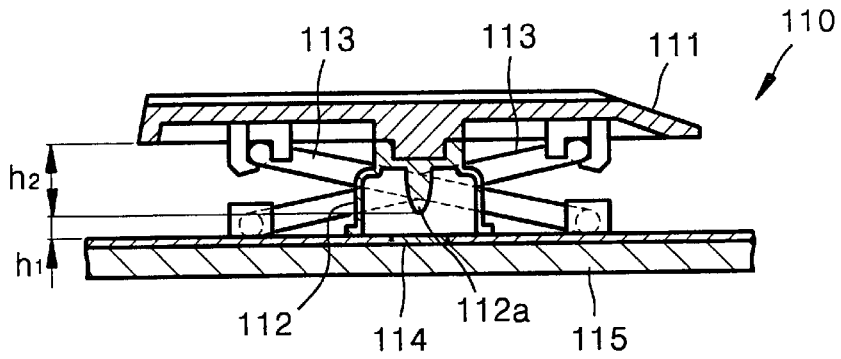
FIG. 3 (PRIOR ART)
FIGS. 3 and 4 are sectional views showing the state of the key switch of FIG. 1 before and after manipulation by a user.
Figure 4:
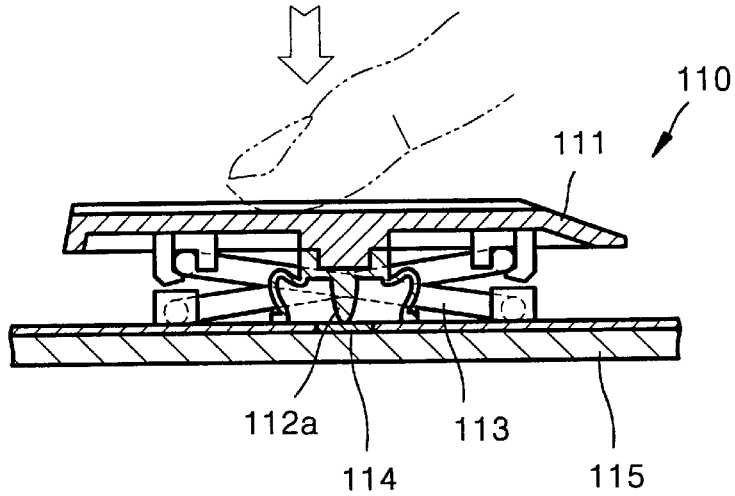
FIG. 4 (PRIOR ART)
Figure 5:
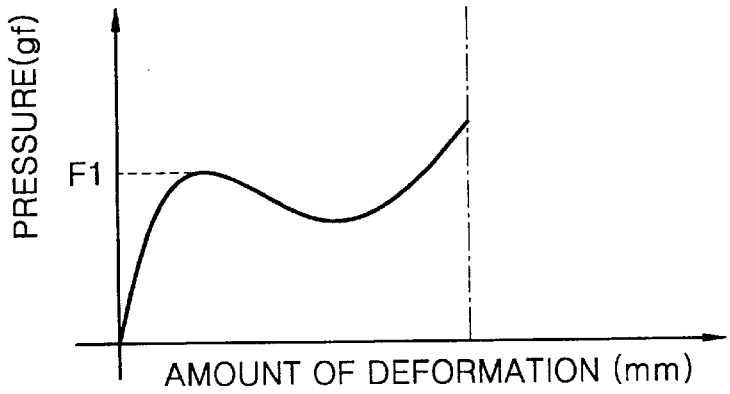
FIG. 5 (PRIOR ART)
FIG. 5 is a graph showing the relationship between a pressure acting on a rubber dome and the amount of a deformation as the key switch of FIG. 1 is manipulated.

In other words, with reference to FIG. 7, even if a height of a stroke H1 in which the contact protrusion 212*d* presses the contact terminal portion 214 is set to be the same as in the conventional key switch 110 (h1 of FIG. 3), the height of the key switch 210 above the substrate 215 can be reduced because a height needed to secure a fatigue strength and a restoration force of the elastic body 212 can be distributed to an upper and lower heights H3 and H2 above and below the upper surface 216 of the substrate 215. In addition, if the elastic body 212 is formed of a plastic material, which exhibits superior elasticity over the rubber dome 112 (FIG. 2), the height of the elastic body 212 itself can be further reduced. Thus, the key switch 210 of the present invention allows the overall height of the key switch 210 to be reduced while providing a smooth operability.

In the above embodiment, the short side portions 213*a* and 213*b* and the long side portions 213*c* of the cross link 213 are integrally formed to guide the deformation of the elastic body 212. However, FIGS. 9A and 9B show another aspect of the present invention, short side portions 213*a*', to which end portions 212*c*' of the elastic body 212' are coupled, are formed to rotate with respect to long side portions 213*c*'.

Figure 10:
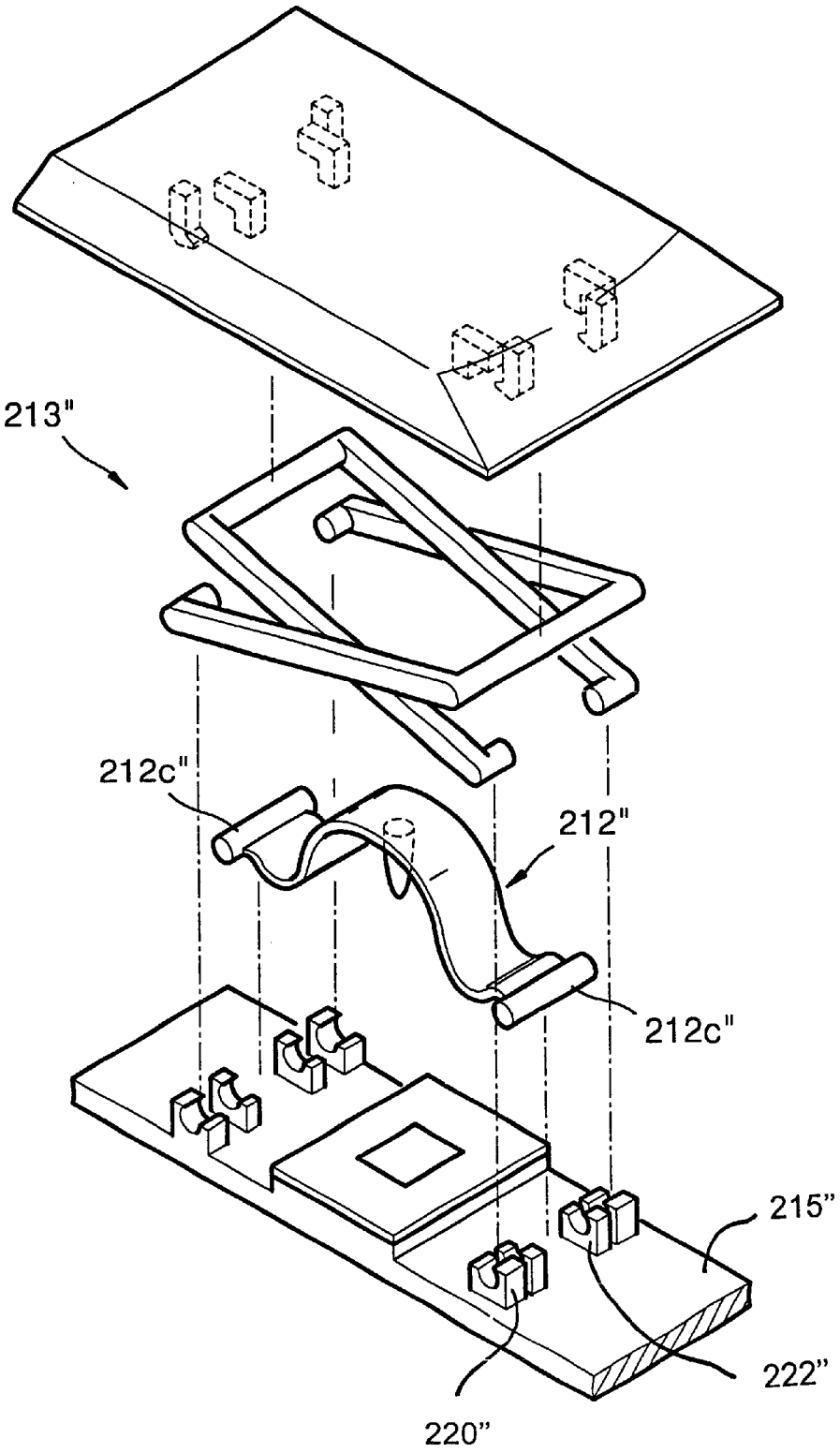

According to still another aspect of the present invention, FIG. 10 shows that end portions 212*c*" of an elastic body 212' are directly installed at clips 222" on a substrate 215" so as to rotate separately from a cross link 213", which are installed using clips 220'.

Figure 9A:
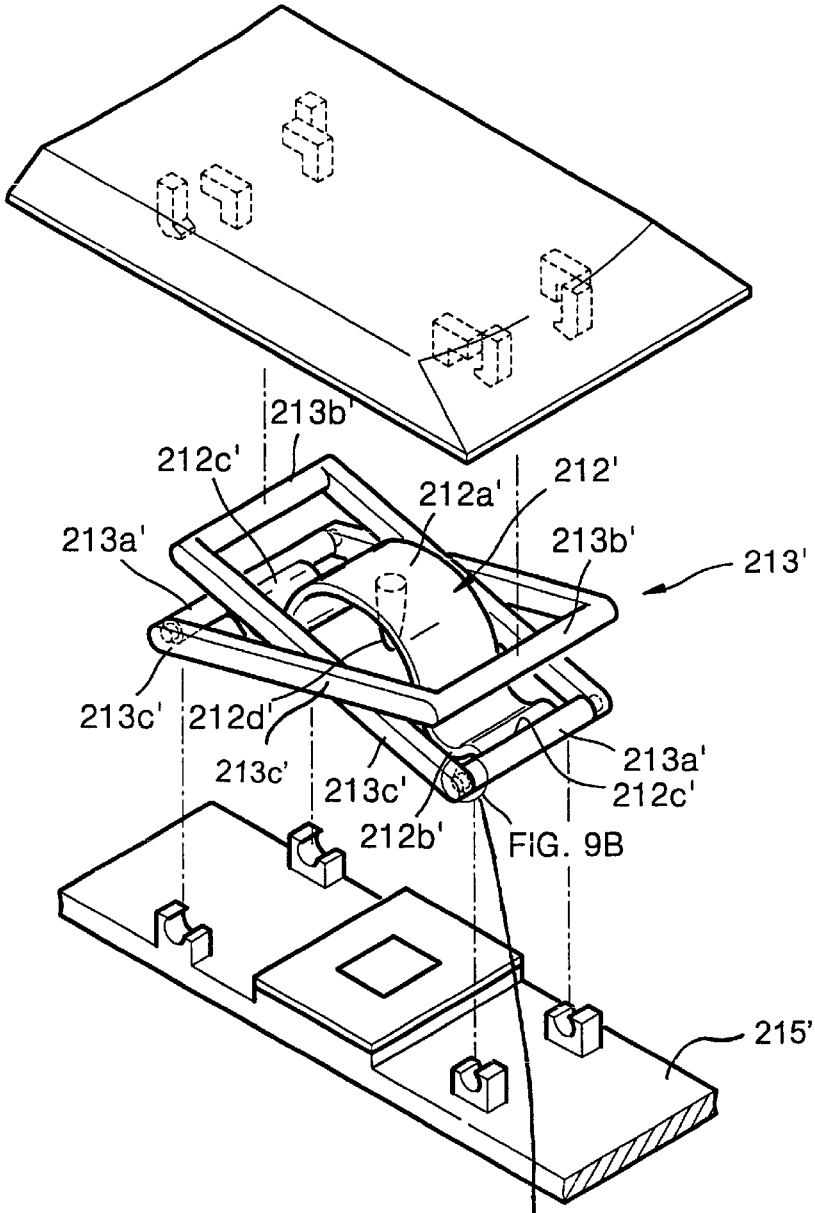
FIGS. 9A through 10 are exploded perspective views showing a modified structure of the key switch of FIG. 6 according to aspects of the present invention.
Figure 9B:
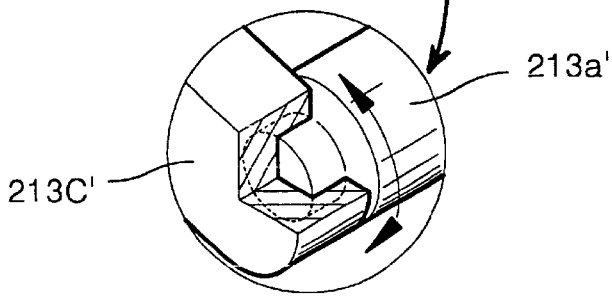

With the modifications shown in FIGS. 9A through 10, end portions of an elastic body can rotate more smoothly.

Figure 11A:
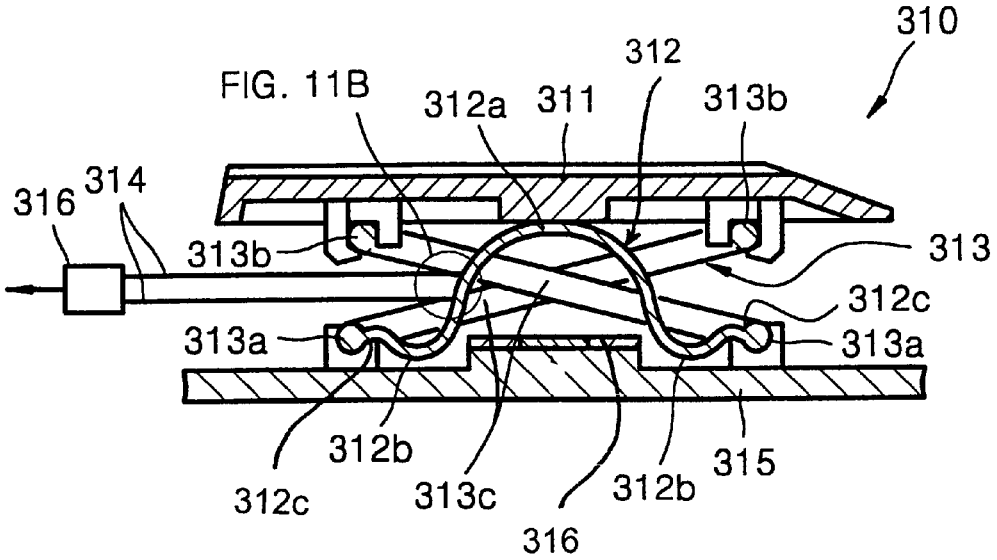
FIGS. 11A and 11B are sectional views showing a key switch according to another embodiment of the present invention.
Figure 11B:
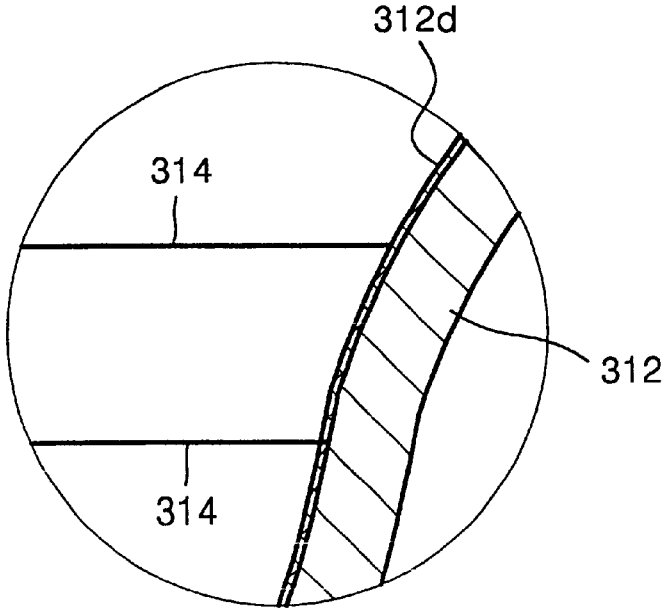

FIGS. 11A and 11B show the structure of a key switch 310 of a key board unit according to another embodiment of the present invention. The key switch 310 includes a key cap 311, a cross link 313 which supports and allows the key cap 311 to move up and down above a substrate 315, and an elastic body 312 which elastically supports the key cap 311 thereunder. The elastic body 312 is a band shaped structure and includes end portions 312*c* coupled to short side portions 313*a* which are pivot shafts of the cross link 313, a central portion 312*a* which contacts a bottom surface of the key cap 311, and curved portions 312*b* formed between corresponding ones of the end portions 312*c* and the central portion 312*a* where a buckling phenomenon occurs. Instead of a contact terminal portion on the substrate 315, a piezoelectric element coating film 312*d* is formed on a surface of the elastic body 312 and generates an electrical signal which is detected by a sensor 316 connected to a signal line 314. That is, unlike the embodiment shown in FIGS. 6 through 10, in which an electric signal is generated as the contact terminal portion 214 is pressed by the contact protrusion 212*d*, in the embodiment shown in FIG. 11A, as the elastic body 312 is deformed, the piezoelectric element coating film 312*d* generates an electrical signal and the generated electric signal is detected by the sensor 316.

As a user presses the key cap 311, the central portion 312*a* of the elastic body 312 is pressed down by the key cap 311. Accordingly, the end portions 312*c* of the elastic body 312 coupled to corresponding ones of the short side portions 313*a* of the cross link 313 are rotated. As a result, the curved portions 312*b* concavely deform in response to the pressure generated as the central portion 312*a* is pressed and the movement generated as the end portions 312*c* are rotated. As the elastic body 312 is deformed, the piezoelectric element coating film 312*d* generates the electrical signal which is detected by the sensor 316 so as to recognize the manipulation of the key switch 310.

As in the embodiment shown in FIG. 6, the curved portions 312*b* also deform at a position below an upper surface 316 of the substrate 315. Therefore, the overall height of the key switch 310 can be reduced. In addition, since the contact protrusion 212*d* of FIG. 6 is not required for this embodiment, the overall height of the key switch 310 can be further reduced by a height corresponding to the height of the contact protrusion 212*d* (FIG. 6). However, the curved portions 312*b* need not deform at a position below the upper surface 316 in all aspects of the invention.

Although FIG. 11B shows that the piezoelectric element coating film 312*d* is formed on an upper surface of the elastic body 312, the same effect can be obtained even if the piezoelectric element coating film 312*d* is formed on a lower surface of the elastic body 312, on a predetermined portion of the elastic body 312, or on any combination thereof. In addition, one or a combination of the structural aspects disclosed in FIGS. 9A through 10 can be incorporated into the embodiment of FIG. 11. That is, to provide a smoother deformation of the elastic body 312, the short side portions 313*a*, to which the end portions 312*c* of the elastic body 312 are coupled, can be formed to rotate with respect to the long side portions 313*c*, Alternatively, end portions 312*c* of the elastic body 312 can be directly installed on the substrate 315 so as to rotate separately from the cross link 313.

As described above, the overall height of a key switch of a keyboard can be reduced without affecting the performance of the key switch by modifying the elastic body elastically supporting the key cap. The present invention allows a production of a slimmer information processor, such as a slimmer notebook computer. Further, while shown using a cross link structure, it is understood that the key switch of the present invention need not include the cross link structure in all aspects of the invention.

Although a few preferred embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A key switch of a keyboard comprising:

a substrate;

a contact terminal portion provided on said substrate;

a key cap which selectively moves up and down and is installed above said contact terminal portion: and an elastic body comprising a band shaped structure and which supports and allows said key cap to elastically move up and down, the band shaped structure comprising a protruding portion which is selectively presses against said contact terminal portion as said key cap moves down, end portions which pivot with respect to and are supported above said substrate, a central portion which is bulged to contact a bottom surface of said key cap, and to which the protruding portion is attached and curved portions having an opposite curvature to that of the central portion disposed between corresponding ones of the end portions and the central portion.

2. The key switch of a keyboard as claimed in claim 1, wherein said elastic body comprises a plastic material.

3. The key switch of a keyboard as claimed in claim 1, further comprising a cross link having first short side portions which are pivotally installed on said substrate;

second short side portions which are coupled to the bottom surface of said key cap; and long side portions which connect the first short side portions to corresponding ones of the second short side portions, wherein the second short side portions support and allow said key cap to move up and down, and the end portions of said elastic body are coupled to corresponding ones of the first short side portions of said cross link.

4. The key switch of a keyboard as claimed in claim 3, wherein the first short side portions of said cross link are coupled to the corresponding ones of the long side portions so as to pivot with respect to the corresponding long side portions.

5. The key switch of a keyboard as claimed in claim 1, further comprising a cross link having first short side portions which are pivotally installed on said substrate;

second short side portions which are coupled to the bottom surface of said key cap; and long side portions which connect the first short side portions to corresponding ones of the second short side portions, wherein the second short side portions support and allow said key cap to move up and down, and the end portions of said elastic body are installed on said substrate so as to pivot independently from the first short side portions of said cross link.

6. The key switch of a keyboard as claimed in claim 1, wherein the curved portions of said elastic body deform at a position lower than an upper surface portion of said substrate, and the contact terminal portion is provided on the upper surface portion of said substrate.

7. The key switch of a keyboard as claimed in claim 1, wherein said elastic body has a predetermined height and a portion of the predetermined height is disposed below an upper surface portion of said substrate, so as to distribute a height needed to secure a fatigue strength and a restoration force of said elastic body to above and below the upper surface portion of said substrate, and the contact terminal portion is provided on the upper surface portion of said substrate.

8. The key switch of a keyboard as claimed in claim 1, wherein the curved portions selectively buckle in response to a predetermined pressure so as to provide a sense of manipulation of said key switch.

9. The key switch of a keyboard as claimed in claim 3, wherein said elastic body has a predetermined height and a portion of the predetermined height is disposed below an upper surface portion of said substrate, so as to distribute a height needed to secure a fatigue strength and a restoration force of said elastic body to above and below the upper surface portion of said substrate.

10. The key switch of a keyboard as claimed in claim 9, wherein the curved portions of said elastic body deform at a position lower than the upper surface portion of said substrate, and selectively buckle in response to a predetermined pressure so as to provide a sense of manipulation of said key switch.

11. The key switch of a keyboard as claimed in claim 10, wherein said elastic body comprises a plastic material, and the contact terminal portion is provided on the upper surface portion of said substrate.

12. The key switch of a keyboard as claimed in claim 5, wherein said elastic body has a predetermined height and a portion of the predetermined height is disposed below an upper surface portion of said substrate, so as to distribute a height needed to secure a fatigue strength and a restoration force of said elastic body to above and below the upper surface portion of said substrate.

13. The key switch of a keyboard as claimed in claim 12, wherein the curved portions of said elastic body deform at a position lower than the upper surface portion of said substrate, and selectively buckle in response to a predetermined pressure so as to provide a sense of manipulation of said key switch.

14. The key switch of a keyboard as claimed in claim 13, wherein said elastic body comprises a plastic material, and the contact terminal portion is provided on the upper surface portion of said substrate.

15. A key switch of a keyboard comprising:

a substrate;

a platform having a predetermined height above said substrate and which is situated on said substrate;

a keycap which selectively moves up and down to generate a signal and is installed above said platform; and an elastic body which supports and allows said key cap to move up and down and having a protruding portion which presses said keycap as said keycap moves down, wherein said elastic body has a portion disposed below said platform so as to secure a buckling of said elastic body at a position below said platform.

16. The key switch of a keyboard as claimed in claim 15, further comprising a contact terminal portion provided on said platform, wherein the signal is generated in response to a contact between a portion of the protruding portion and said contact terminal portion.

17. The key switch of a keyboard as claimed in claim 15, further comprising a piezoelectric element coating film which is provided on a surface of said elastic body and generates the signal according to a deformation of said elastic body.

* * * * *